US007780036B2

(12) United States Patent
Splain et al.

(10) Patent No.: US 7,780,036 B2
(45) Date of Patent: Aug. 24, 2010

(54) HANDBASKET

(75) Inventors: William D. Splain, Brooklyn Park, MN (US); Robert D. Peota, Minneapolis, MN (US); Alexandre Hennen, Cambridge, MA (US); Allan Cameron, Natick, MA (US)

(73) Assignee: Target Brands, Inc., Minneapolis, MN (US)

( * ) Notice: Subject to any disclaimer, the term of this patent is extended or adjusted under 35 U.S.C. 154(b) by 1159 days.

(21) Appl. No.: 11/231,307

(22) Filed: Sep. 19, 2005

(65) Prior Publication Data

US 2007/0062960 A1 Mar. 22, 2007

(51) Int. Cl.
*B65D 25/32* (2006.01)

(52) U.S. Cl. ..... 220/774; 206/505; 206/506; 206/510; 206/821; 220/752; 220/755; 220/760; 220/768; 220/769

(58) Field of Classification Search ..... 220/755, 220/762, 763, 765, 773, 774, 752, 760, 761, 220/764, 768, 769, DIG. 14; 206/505, 506, 206/510, 821
See application file for complete search history.

(56) References Cited

U.S. PATENT DOCUMENTS

| | | | | |
|---|---|---|---|---|
| 60,337 | A * | 12/1866 | Brown | 220/774 |
| 343,711 | A | 6/1886 | Jeppesen | |
| 345,897 | A | 7/1886 | Heath | |
| 367,211 | A | 7/1887 | Kimball | |
| 383,671 | A | 5/1888 | Shallenberger | |
| 384,815 | A | 6/1888 | Wood | |
| 395,362 | A | 1/1889 | Spangenberg | |
| 397,250 | A | 2/1889 | Rowlands | |
| 401,067 | A | 4/1889 | Reilly | |
| 447,688 | A | 3/1891 | Isaacs | |
| 449,102 | A | 3/1891 | Andrews | |

(Continued)

FOREIGN PATENT DOCUMENTS

| | | |
|---|---|---|
| EP | 0 115 439 | 1/1984 |

(Continued)

OTHER PUBLICATIONS

Pending (IFW) U.S. Appl. No. 11/231,307, inventor Splain et al., filed on Sep. 19, 2005.

(Continued)

*Primary Examiner*—Mickey Yu
*Assistant Examiner*—Elizabeth Volz
(74) *Attorney, Agent, or Firm*—Griffiths & Seaton PLLC

(57) ABSTRACT

A handbasket includes a container and a handle. The container includes an upper rim, a pair of opposed side panels, and a pair of opposed end panels, with each side panel including a generally concave exterior surface. The handle extends between, and is pivotally mounted relative to, the respective opposed end panels of the container. The handle is movable between a first generally vertically upright position relative to the container and a second position. In the second position, a first portion of the handle rests against the upper rim of the container and a second portion of the handle is spaced from the upper rim adjacent the generally concave exterior surface of one of the respective side panels to define a grasping zone for grasping the handle for movement between the first position and the second position of the handle relative to the container.

11 Claims, 4 Drawing Sheets

U.S. PATENT DOCUMENTS 462,266 A 11/1891 Miles
466,301 A 12/1891 Green
496,272 A 4/1893 Miebach
497,253 A 5/1893 Reynolds
1,488,397 A * 3/1924 Judge et al. ..... 220/23.4
D100,402 S 7/1936 Wagner
2,060,468 A 11/1936 Mitchell
2,479,530 A 8/1949 Watson
D155,392 S 10/1949 Danielson
D155,971 S 11/1949 Concklin
D156,702 S 1/1950 Concklin
2,527,953 A 10/1950 Muffley
2,906,542 A 9/1959 Hoedinghaus et al.
3,195,912 A 7/1965 Howard et al.
3,346,271 A 10/1967 Parsons
3,999,774 A 12/1976 Rehrig
4,046,394 A 9/1977 Thompson, Jr.
D247,953 S 5/1978 Rehrig
4,123,077 A 10/1978 Joseph
4,139,098 A 2/1979 Mollon
4,268,049 A 5/1981 Salvador
4,273,346 A 6/1981 Rehrig
4,376,502 A 3/1983 Cohen
4,478,344 A 10/1984 Rehrig
4,537,413 A 8/1985 Rehrig
4,555,123 A 11/1985 Rehrig
D283,966 S 5/1986 Carlson
4,632,411 A 12/1986 Badger
4,650,199 A 3/1987 Rehrig
D294,419 S 2/1988 Rehrig
D296,259 S 6/1988 Rehrig
D296,643 S 7/1988 Mueller
4,841,586 A * 6/1989 Juster et al. ..... 5/181
4,865,338 A 9/1989 Rehrig
4,922,639 A 5/1990 Rehrig
4,941,586 A * 7/1990 Tarna ..... 222/572
D311,983 S 11/1990 Rehrig
D317,219 S 5/1991 Rehrig
D326,550 S 5/1992 Waterman
5,111,604 A 5/1992 Rehrig
D330,964 S 11/1992 Hampshire
5,203,578 A 4/1993 Davidson et al.
5,210,968 A 5/1993 Rehrig
5,255,930 A 10/1993 Jones et al.
D343,711 S 1/1994 Craft et al.
5,289,936 A 3/1994 Jones et al.
D345,897 S 4/1994 Vitez
5,331,756 A 7/1994 Rehrig
5,368,318 A 11/1994 Rehrig et al.
5,441,288 A 8/1995 Rehrig
5,458,347 A 10/1995 Chiv
D364,961 S 12/1995 Rehrig
D367,211 S 2/1996 Cautereels
D377,255 S 1/1997 Rehrig
D382,999 S 9/1997 Rehrig
D383,671 S 9/1997 Phillips
D384,815 S 10/1997 Rehrig
5,715,968 A 2/1998 Fink et al.
D395,362 S * 6/1998 Fink et al. ..... D3/307
5,769,435 A 6/1998 Nishida
D397,250 S 8/1998 Fink et al.
D400,679 S 11/1998 Kern et al.
D401,067 S 11/1998 Hampshire
5,865,448 A 2/1999 Kern et al.
5,871,286 A 2/1999 Kern et al.
5,915,704 A 6/1999 Segura de Luna
D412,046 S 7/1999 Rehrig et al.
5,947,313 A 9/1999 Kern et al.
D421,336 S 3/2000 Demore et al.
6,039,205 A 3/2000 Flink
D426,365 S 6/2000 Rehrig et al.
6,155,580 A 12/2000 Symons
D438,010 S 2/2001 Drury et al.
D443,968 S 6/2001 Porter
D444,035 S 6/2001 Austen-Meek
D444,281 S 6/2001 Gaze et al.
D445,231 S 7/2001 Porter
6,270,093 B1 8/2001 Johnson et al.
D447,688 S 9/2001 Jalet et al.
D449,102 S 10/2001 Shin
D462,266 S 9/2002 Gittins et al.
D466,301 S 12/2002 Sofy
D468,880 S 1/2003 Porter
D470,292 S 2/2003 Johnson et al.
6,540,240 B2 4/2003 Nadeau et al.
D474,603 S 5/2003 Berenguer
6,572,122 B2 6/2003 Johnson et al.
6,669,212 B2 12/2003 Porter
6,705,623 B2 3/2004 Nadeau et al.
6,736,415 B1 5/2004 Lenihan
6,761,364 B2 7/2004 Murar et al.
D496,272 S 9/2004 Jackson et al.
D497,253 S * 10/2004 Alves ..... D3/309
6,805,365 B2 10/2004 Lantz
6,981,708 B1 1/2006 Tucker et al.
D530,478 S 10/2006 Splain et al.
D536,874 S 2/2007 Splain et al.
7,237,782 B2 7/2007 Tucker et al.
D550,423 S 9/2007 Splain et al.
D556,413 S 11/2007 Splain et al.
2002/0135144 A1 9/2002 Murar et al.
2003/0116933 A1 6/2003 Nadeau et al.
2005/0189360 A1 9/2005 Loucks et al.
2006/0086746 A1 * 4/2006 Chen ..... 220/772

FOREIGN PATENT DOCUMENTS

EP 0 161 108 3/1985
EP 0 161 890 3/1985
WO WO 93/02903 2/1993
WO WO 93/11018 6/1993
WO WO 95/03201 2/1995
WO WO 96/04161 2/1996
WO WO 97/30880 8/1997

OTHER PUBLICATIONS

U.S. Appl. No. 29/269,260, filed Nov. 27, 2006, and entitled "Handbasket".

Plastic shopping cart web page, IPT, Inc., available at http://www.inplastech.com/Products_EX11575WM_LG.asp; printed out Jan. 24, 2006. (2 pages).

The Supercart Hyper Trolley web page, Supercart, available at http://www.supercart.com/supercart/page.asp?SectionID=2&PageID=3; printed out May 13, 2005. (1 page).

The Supercart Mid Size Supercart Trolley web page, Supercart, available at http://www.supercart.com/supercart/page.asp?SectionID=2&PageID=4; printed out May 13, 2005. (1 page).

The Supercart Grocer Trolley web page, Supercart, available at http://www.supercart.com/supercart/page.asp?SectionID=2&PageID=5; printed out May 13, 2005. (1 page).

The Full Size all-plastic Supercart trolley web page, Supercart, available at http://www.supercart.com/supercart/page.asp?SectionID=2&PageID=6; printed out May 13, 2005. (2 pages).

Photo of Cart Icon from Greeley, Colorado, icon on public display 2nd Quarter 2004.

Photos (pp. 2) of SuperCart Shopping Trolley at Euroshop Tradeshow in Dusselldorf, Germany in Feb. 19-23, 2005.

ARRK Prototype Brochure (pp. 2) documenting Supercart Trolley display in Feb. 19-23, 2005.

Photo A of Handbasket on display at Euroshop Tradeshow in Dusseldorf, Germany in Feb. 19-23, 2005.

Photo B of Handbasket on display at Euroshop Tradeshow in Dusseldorf, Germany in Feb. 19-23, 2005.

Pending (IFW) U.S. Appl. No. 11/231,283, inventor Peota et al., filed on Sep. 19, 2005.
Pending (IFW) U.S. Appl. No. 11/231,364, inventor Splain et al., filed on Sep. 19, 2005.
Pending (IFW) U.S. Appl. No. 11/231,313, inventor Splain et al., filed on Sep. 19, 2005.
Pending (IFW) U.S. Appl. No. 11/231,343, inventor Splain et al., filed on Sep. 19, 2005.
Pending (IFW) U.S. Appl. No. 11/231,344, inventor Splain et al., filed on Sep. 19, 2005.
Pending (IFW) U.S. Appl. No. 29/238,739, inventor Splain et al., filed on Sep. 19, 2005.
Pending (IFW) U.S. Appl. No. 29/238,740, inventor Splain et al., filed on Sep. 19, 2005.
US 5,201,134, 04/1993, Rehrig et al. (withdrawn)

* cited by examiner

HANDBASKET

BACKGROUND OF THE INVENTION

Many shopping experiences involve selecting and purchasing only a few items. In many instances, customers simply carry items in their hands or arms until they arrive at a checkout counter. However, many consumers quickly find that they begin to select more items for purchase or select items bigger than they can readily carry. In those instances, they return to the entrance of the store to get a shopping cart or a handbasket.

Most stores offer a handbasket for shopping when only a few items are desired. When available, many customers will more willingly use a handbasket than a shopping cart for buying a small number of items. However, conventional handbaskets have their own inconveniences. For example, many conventional handbaskets include a pair of wire handles that require the use of two hands to gather together before the handbasket is transferred over to a single hand for carrying. Moreover, completing this maneuver usually requires the customer to awkwardly stoop over in the store as they attempt to pick up the handbasket. In addition, the wire handles often rest directly against an upper edge of the handbasket, making it even more difficult to grasp the wire handles with their fingers. Finally, the wire handles in conventional handbaskets typically are oriented in a manner forcing a customer to rotate their hand and forearm outwardly in order to carry the handbasket at their side.

Today's consumer is looking for convenience and ease wherever they can find it, and conventional handbaskets fall well short.

SUMMARY OF THE INVENTION

Embodiments of the invention are directed to a handbasket. In one embodiment, the handbasket includes a container and a handle. The container includes an upper rim, a pair of opposed side panels, and a pair of opposed end panels, with each side panel including a generally concave exterior surface. The handle extends between, and is pivotally mounted relative to, the respective opposed end panels of the container. The handle is movable between a first generally vertically upright position relative to the container and a second position. In the second position, a first portion of the handle rests against the upper rim of the container and a second portion of the handle is spaced from the upper rim adjacent the generally concave exterior surface of one of the respective side panels to define a grasping zone for grasping the handle for movement between the first position and the second position of the handle relative to the container.

BRIEF DESCRIPTION OF THE DRAWINGS

Embodiments of the invention will be described with respect to the figures, in which like reference numerals denote like elements, and in which.

DETAILED DESCRIPTION

In the following detailed description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Embodiments of the invention are directed to a handbasket. In one embodiment, a handle is pivotally movable relative to a container via a pivot mechanism between an unlocked, storage position resting against an upper rim of the container and a locked, upright position for carrying the handbasket. The ergonomic shape of the container enables quick, grab-and-go grasping of the handle to make the handbasket easy to pick up and carry. In one aspect, the pivot mechanism enables an automatic transition between the unlocked, storage position and the locked, upright position based only on whether the customer lifts or releases the handle. In one embodiment, a container of the handbasket also comprises a pair of elongate slots disposed at opposite end portions of the container to enable optional hand gripping of the container independent of the handle.

In one aspect, a longitudinal axis of the handle is aligned generally parallel to a longitudinal axis of the container to provide a large surface area for inserting articles into the container when the handle is in the generally upright position. This arrangement also enables the consumer to hold the handle with a more natural arm position in which the handle is gripped without rotation of the customer's hand and arm outward away from the body, as sometimes is required with conventional handbaskets. This ergonomic orientation of the handle makes the use of a handbasket more comfortable and enjoyable for the customer.

These embodiments, and additional embodiments, are described in association with FIGS. 1-6.

Figure 1:
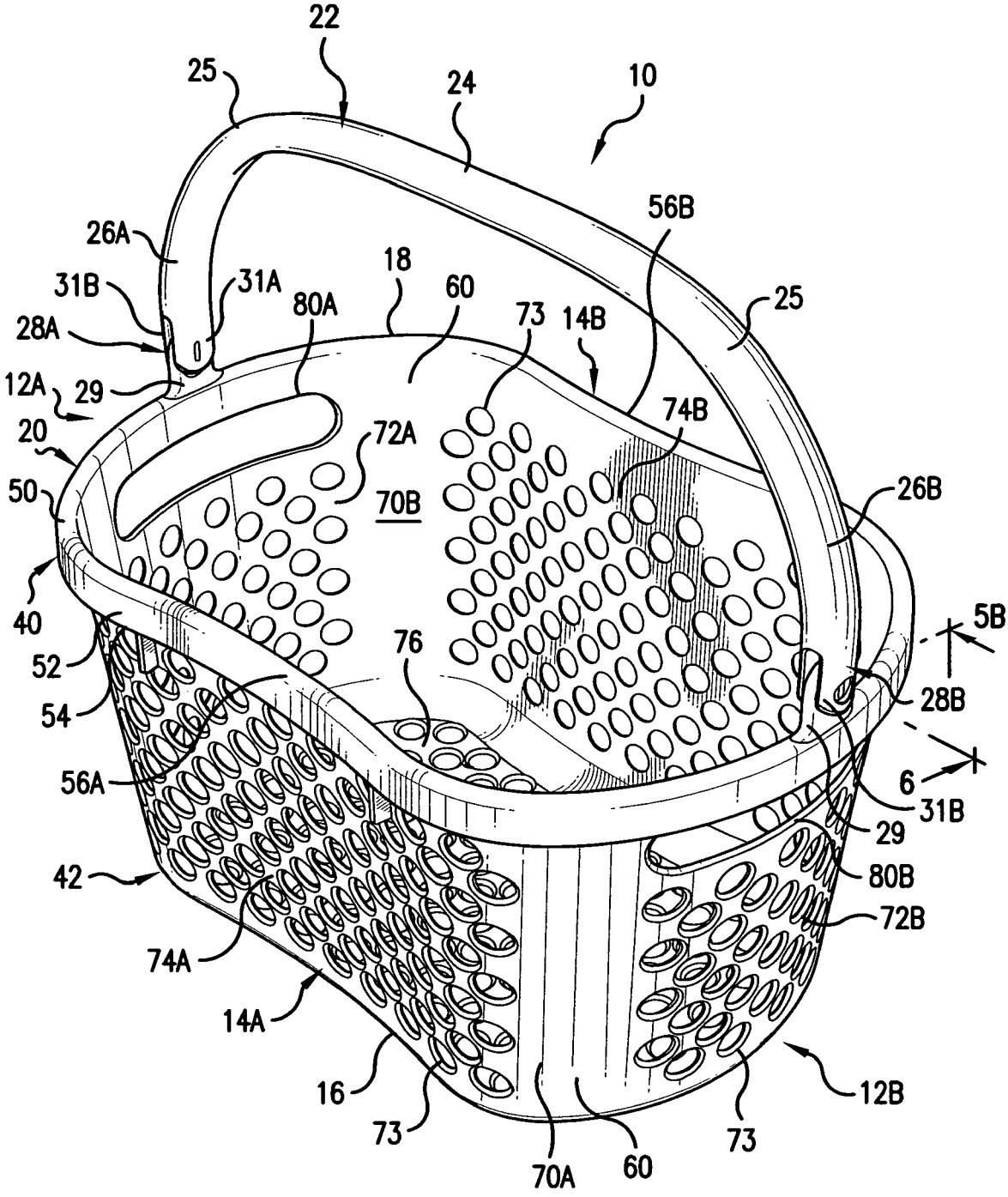
FIG. 1 is an isometric view of a handbasket, according to an embodiment of the invention.

As shown in FIG. 1, handbasket 10 comprises opposite ends 12A and 12B, opposite sides 14A,14B, bottom 16 and top 18. In one embodiment, handbasket 10 comprises container 20, handle 22, and a pair of pivot mechanisms 28A, 28B. Handle 22 is pivotally movable relative to container 20, via the pivot mechanisms 28A, 28B, between a locked, transport position shown in FIG. 1 (and FIGS. 5B, 6) and an unlocked, storage position, as shown and described later in association with FIGS. 2-5A. As shown in FIG. 1, in the locked, transport position, handle 22 extends generally vertically upward relative to container 20.

In one embodiment, the handle 22 comprises midportion 24, corner portions 25, and end portions 26A, 26B. Each end portion 26A,26B of handle 22 comprises a pair of flanges 31A, 31B configured for operation as part of the respective pivot mechanisms 28A,28B to enable pivotally mounting handle 22 relative to container 20 at the respective ends 12A, 12B of handbasket 10. Midportion 24 of handle 22 is generally perpendicular to, and extends between, the respective end portions 26A,26B of handle 22. In one aspect, a longitudinal axis of handle 22 extends generally parallel to a longitudinal axis of container 20, which extends between the respective ends 12A, 12B of handbasket 10.

In one aspect, aligning the longitudinal axis of handle 22 with the longitudinal axis of container 20 increases the relative amount of available surface area to insert objects into container 20 when handle 22 is in the generally upright position shown in FIG. 1. In other words, larger objects can be placed in container 20 than possible with a conventional handle having a longitudinal axis extending generally perpendicular to a longitudinal axis of its container. Moreover, in one aspect, the single pivot mechanism 28A, 28B located at the respective ends 12A, 12B of handbasket 10 also enables a relatively larger surface area for loading objects into container 20 when handle 22 is in a generally upright position, as opposed to conventional handbaskets having multiple pivot points on each side of their containers.

In one embodiment, the container 20 includes upper rim 40, which comprises top surface 50, side surface 52, bottom surface 54, and recesses 56A and 56B. In one aspect, upper rim 40 comprises a tab 29 adjacent opposites ends 12A, 12B of handbasket with each tab 29 extending generally vertically upward from top surface 50 of upper rim 40 of container 20 and forming a portion of respective pivot mechanisms 28A, 28B. Tab 29 is illustrated and described in more detail in association with FIGS. 5A, 5B, and 6.

Container 20 also comprises generally vertical end panels 72A and 72B with each end panel 72A,72B disposed at a respective end 12A,12B of the handbasket 10. Container 20 also comprises generally vertical side panels 74A and 74B with each side panel disposed at a respective side 14A,14B of the handbasket 10. In one embodiment, each side panel 74A, 74B defines a generally concave, curved exterior surface facing away from container 20 and a generally convex, curved interior surface facing an interior of container 20. In one aspect, the size and shape of the respective recess 56A, 56B of upper rim 40 substantially matches a size and shape of the generally curved shape of the respective side panels 74A, 74B.

In another aspect, container 20 also comprises four corner portions 60, with each corner portion interposed between adjacent respective panels 72A, 74A, 72B, 74B. Each corner portion 60 includes an outer surface 70A defining a generally convex curved portion and inner surface 70B defining a generally concave curved portion, with each outer surface 70A and inner surface 70B defining a generally smooth surface without holes.

Container 20 also comprises a bottom panel 76 extending generally longitudinally between ends 12A and 12B of handbasket 10 and extending generally laterally between sides 14A and 14B of handbasket 10. In one embodiment, bottom panel 76 comprises a member defining a plurality of holes 73. In another embodiment bottom panel 76 comprises a member without holes.

As shown in FIG. 1, each end panel 72A, 72B and side panel 74A,74B of container 20 comprises a member defining a plurality of holes 73. In another embodiment, one or more of end panels 72A, 72B and side panels 74A,74B of container 20 comprise a member without holes 73. In one embodiment, holes 73 are generally round or circularly shaped, while in other embodiments, holes 73 comprise another shape such as a generally rectangular shape, a generally triangular shape, etc.

In another embodiment, as shown in FIG. 1, container 20 comprises an elongate slot 80A,80B formed in a respective end panel 72A, 72B of container 20. Each elongate slot 80A, 80B, in combination with upper rim 40, acts a handle to enable picking up opposite ends 12A, 12B of handbasket 10 with a pair of hands. In this aspect, elongate slots 80A, 80B enable carrying handbasket 10 without handle 22 when desired by the customer. This arrangement also enables another method of handling container 20 for storage, collection, and other purposes. In another embodiment, elongate slots 80A, 80B are not strictly limited to the shape shown in FIGS. 1-2.

In one aspect, each elongate slot 80A,80B is positioned adjacent upper rim 40 of container 20. In another aspect, each elongate slot 80A, 80B has a length extending across a respective end panel 74A,74B of container 20. The length is substantially the same as a width of the respective end panel 74A, 74B extending between adjacent corner portions 60. In another embodiment, container 20 omits one or more of elongate slots 80A, 80B. In one embodiment, each elongate slot 80A, 80B is positioned vertically above a plurality of holes 73 formed in the respective end panel 72A, 72B.

Figure 2:
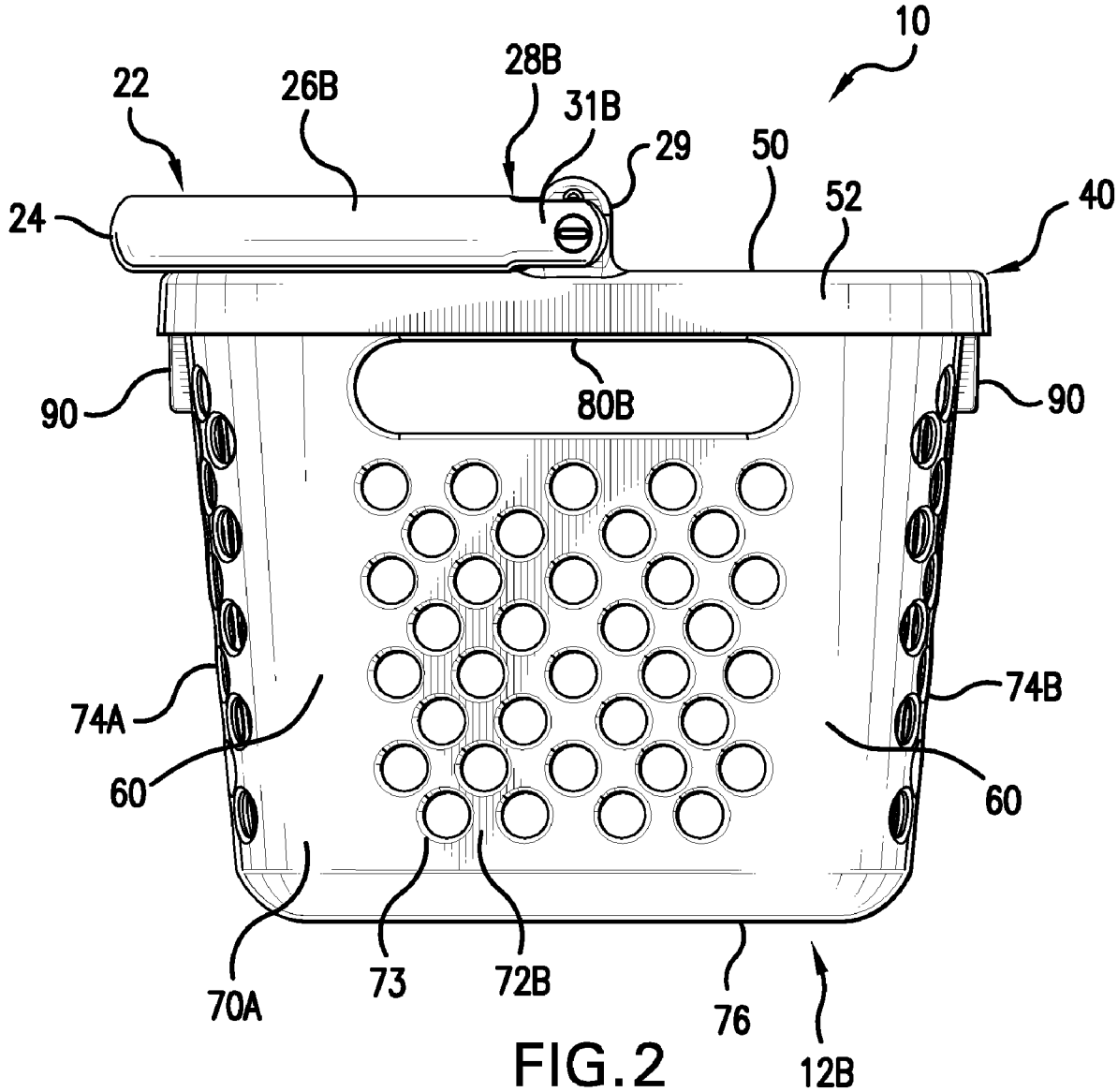
FIG. 2 is an end plan view of the handbasket of FIG. 1, according to an embodiment of the invention.

FIG. 2 is an end view of handbasket 10, according to one embodiment of the invention, illustrating end 12B of handbasket 10 with handle 22 in an unlocked, storage position. This position of handle 22 relative to container 20 is described later in more detail in association with FIG. 5A, which is a sectional view of pivot mechanism 28A.

As shown in FIG. 2, when handle 22 is in the unlocked, storage position, handle 22 rests against top surface 50 of rim 40. In one embodiment, as shown in FIG. 2, container 20 comprises at least one ridge 90 disposed generally vertically along one or more side panels 74A and 74B. Each ridge 90 is positioned adjacent upper rim 40 and extends generally outward from a surface of side panels 74A,74B. Each ridge is sized and shaped to maintain spacing between a pair of adjacent handbaskets 10 when multiple handbaskets are nested together in a stacked configuration. In another embodiment, container 20 omits ridges 90.

Figure 3:
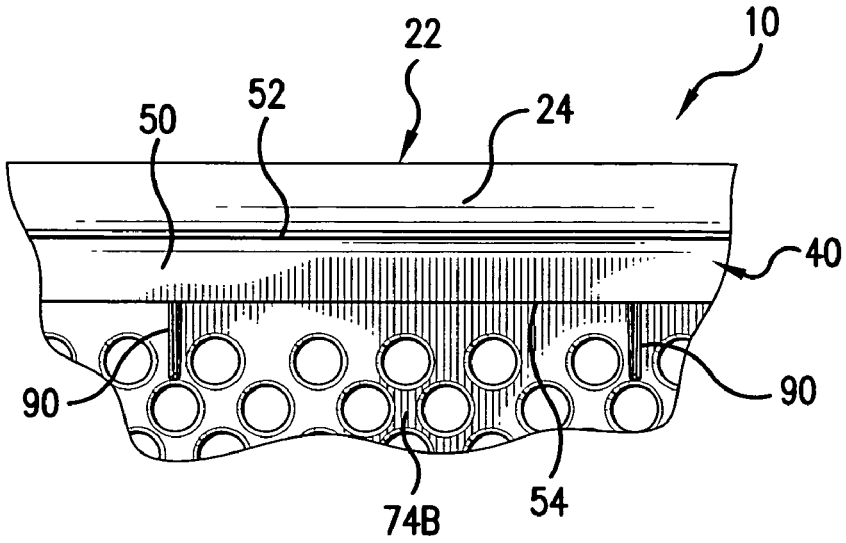
FIG. 3 is a partial side view of the handbasket of FIG. 1, according to an embodiment of the invention.

FIG. 3 is a side view of side panel 74B of handbasket 10, according to one embodiment of the invention, further illustrating a pair of ridges 90. As shown in FIG. 3, the pair of ridges 90 are laterally spaced apart from each other along one of the respective side panels (e.g. side panel 74B or side panel 74A).

Figure 4:
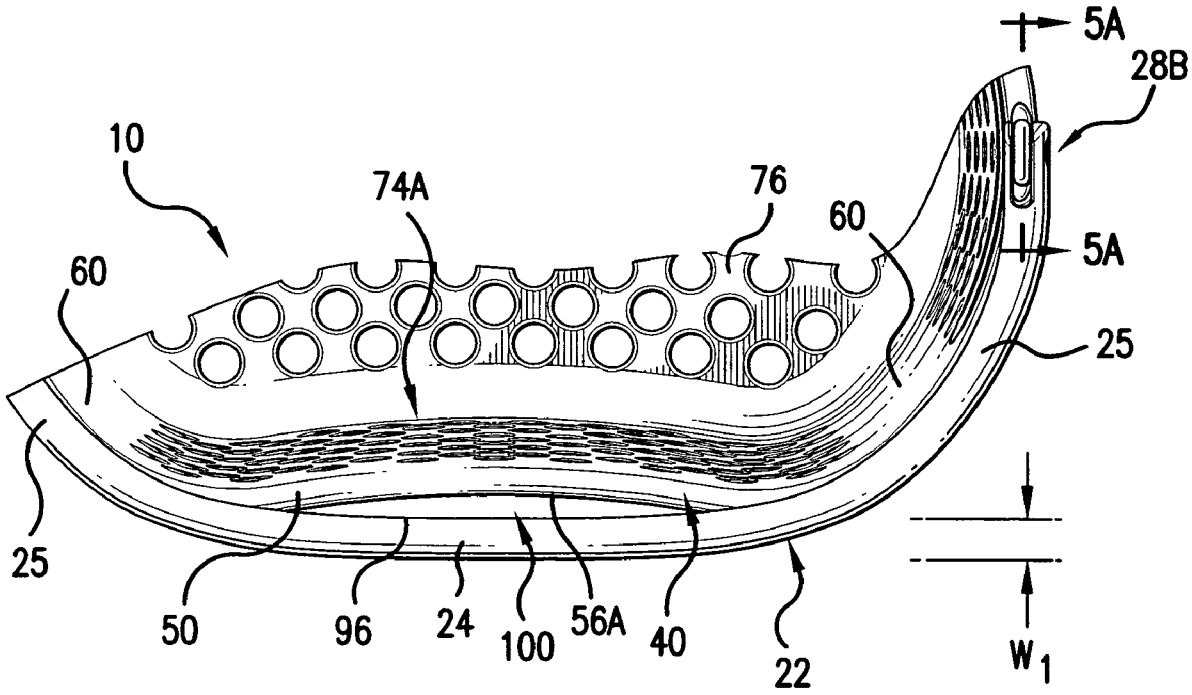
FIG. 4 is a partial top plan view of the handbasket of FIG. 1, according to an embodiment of the invention.

FIG. 4 is a partial top plan view of handbasket 10, according to one embodiment of the invention. As shown in FIG. 4, side panel 74A defines an exterior concave surface and an interior convex surface. In one embodiment, FIG. 4 also represents a corresponding structure for the side panel 74B of container 20 relative to handle 22. In another embodiment, side panel 74B does not have a structure corresponding to side panel 74A and recess 56A.

As shown in FIG. 4, when handle 22 is positioned in the storage position to rest along top surface 52 of upper rim 40, end portions 26A, 26B of handle 22 (FIG. 2) and corner portions 25 of handle 22 (FIG. 4) rest directly on top surface 50 of upper rim 40. At the same time, midportion 24 of handle 22 extends freely apart from and is spaced laterally from recess 56A of upper rim 40 of container 20. This arrangement defines a grasping zone 100 at handle 22 sized and shaped to enable a consumer to slip their fingers around midportion 24 of handle 22 without interference from upper rim 40. In one embodiment, the space between midportion 24 of handle 22 and upper rim 40, as enabled via recess 56A, has a length of W2 extending generally parallel to a longitudinal axis of handbasket 10. In another embodiment, as shown in FIG. 4, the space between midportion 24 of handle 22 and upper rim 40, as enabled via recess 56A, has a depth of W1, extending generally perpendicular to a longitudinal axis of handbasket 10, relative to inner surface 96 of midportion 24 of handle 22. In one aspect, the depth W1 comprises at least the thickness of one or more human fingers to enable insertion of fingers through grasping zone 100 and grasping of handle 22 in the unlocked, resting position shown in FIG. 2.

In another embodiment, recess 56A comprises a generally rectangular shape or other shape. In another embodiment, upper rim 40 of container 20 adjacent side panel 74A omits recess 56A and instead grasping zone 100 is enabled and defined via a bowed portion of midportion 24 of handle 22 that extends generally away from and is spaced from a generally straight side panel 74A of container 20.

Accordingly, embodiments of the invention, as shown in FIG. 4, enable aligning handle 22 so that a grasping zone 100 is aligned generally parallel to a longitudinal axis of handbasket 10. In this ergonomic orientation, a customer can easily grab midportion 24 of handle 22 without requiring rotation of the customer's hand and arm from its natural hanging position alongside their body. This arrangement enables a customer to easily to grab the handle and go with the handbasket, without having to stop to use two hands to grasp a handbasket as typically required by a conventional handbasket. In addition, once the handle 22 is grasped and lifted up to its locked carrying position (FIG. 1), this arrangement of handle 22 and container 20 of handbasket 10 enables the customer to maintain their hand and arm in a natural position hanging alongside their body without rotating their hand and arm outward from the side of their body.

Figure 5A:
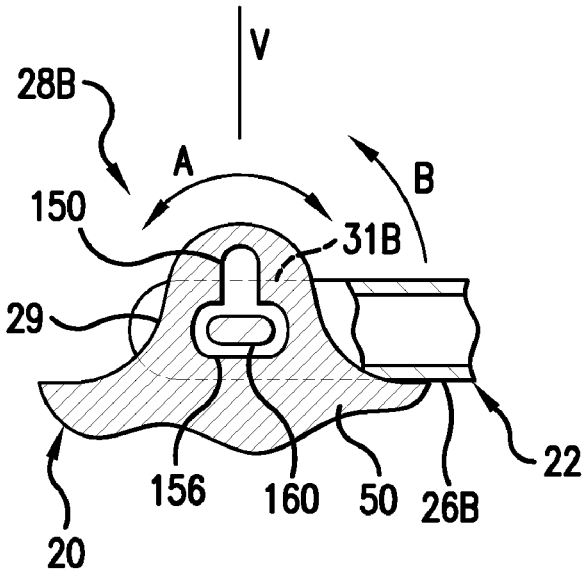
FIG. 5A is a sectional view of the embodiment of FIG. 2 as taken along line 5B-5B of FIG. 4, according to an embodiment of the invention, schematically illustrating the handle in an unlocked, storage position.
Figure 5B:
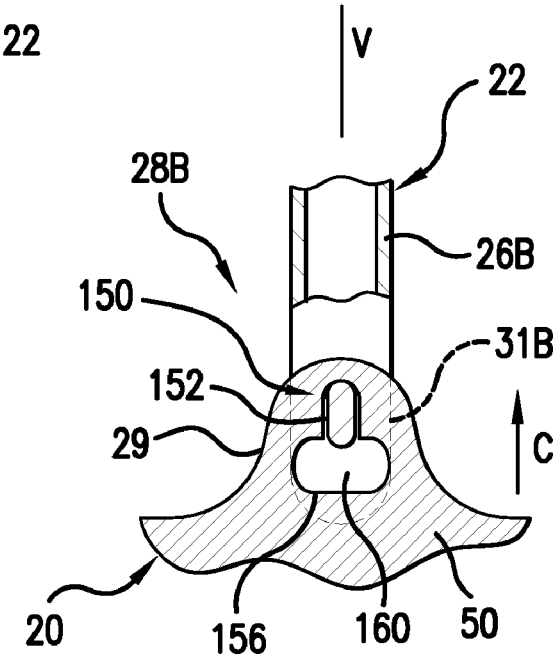
FIG. 5B is a sectional view of the embodiment of FIG. 1 as taken along line 5B-5B of FIG. 1, according to an embodiment of the invention, schematically illustrating the handle in a locked, transport position.
Figure 6:
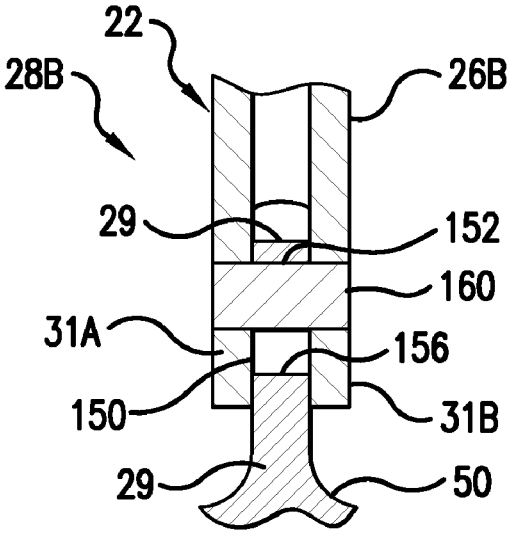
FIG. 6 is a sectional view of the embodiment of FIG. 1 as taken along line 6-6 of FIG. 1, according to an embodiment of the invention, schematically illustrating the handle in a locked, transport position.

FIGS. 5A, 5B, 6 are enlarged sectional views of pivot mechanism 28B of handbasket 10, according to one embodiment of the invention. FIG. 5A is a sectional view of pivot mechanism 28B of the embodiment of FIG. 4 as taken along line 5A-5A and generally corresponds to handle 22 being in an unlocked, storage position, such as shown in FIG. 4. FIG. 5B is a sectional view of pivot mechanism 28B of the embodiment of FIG. 1 as taken along line 5B-5B and generally corresponds to handle 22 being in an locked, carrying position, such as shown in FIG. 1. FIG. 6 is a sectional view of pivot mechanism 28B of the embodiment of FIG. 1 as taken along line 6-6 and generally corresponds to handle 22 being in an locked, carrying position, such as shown in FIG. 1. FIGS. 5A, 5B, and 6 also represent a corresponding structure for pivot mechanism 28A of handbasket 10.

As shown in FIG. 5A, pivot mechanism 28B comprises tab 29 of container 20 with tab 29 extending generally upward from top surface 50 of upper rim 40 of container 20 and defining a hole 150 including an upper elongate slot 152 and a lower portion 156. Pivot mechanism 28B also comprises various components of end portion 26B of handle 22 including the pair of flanges 31A, 31B that straddle tab 29 (shown in FIG. 1) and generally flat pin 160. With handle 22 pivotally mounted relative to container 20, pin 160 also extends through hole 150 of tab 29 of container 20 between the respective flanges 31A, 31B of end portion 26B.

In one aspect, upper elongate slot 152 of hole 150 is sized and shaped to slidably receive pin 160, as shown in FIGS. 5B, 6. In another aspect, as shown in FIG. 5A, lower portion 156 of hole 150 is sized and shaped to enable pivotal rotation of pin 160 within lower portion 156 of hole 150, which generally corresponds to a pivotal movement of end portion 26B of handle 22, as represented by directional arrow A. In another aspect, lower portion 156 of hole 150 comprises a generally circular shaped hole or other shape suitable for enabling rotation of pin 160 within lower portion 156 of hole 150. This arrangement enables handle 22 to be pivotally moved to either side 14A, 14B of handbasket 10 as desired, as represented by directional arrow A in FIG. 5A.

Once a customer chooses to pick up handbasket 10, they grasp handle 22 and pivotally move handle 22 in a direction corresponding to directional arrow B until pin 160 is generally aligned with upper elongate slot 152 of hole 150 which generally corresponds to handle 22 extending generally vertically upward relative to container 20, as shown in FIG. 1. Once in this position, as the customer lifts the handle 22 generally upward (as represented by directional arrow C in FIG. 5B), pin 160 slidably moves into slot 152 until pin 160 is releasably secured within slot 152, shown in FIG. 5B. This arrangement generally corresponds to handle 22 being in the locked, carrying position with handle 22 extending generally vertically upward relative to container 20, as shown in FIG. 1. As the customer maintains upward pressure on handle 22, which naturally occurs while carrying handbasket 10 via handle 22, pin 160 remains within slot 152 of hole 150 to thereby lock handle 22 in the generally upright position during carrying of the handbasket. In one aspect, when pivot mechanism 28B is in this locked position, the size and shape of slot 152 relative to pin 160 prevents rotation of pin 160, thereby generally preventing rotation of handle 22 relative to container 20 when in this upright carrying position.

FIG. 6 is a sectional view further illustrating interaction of pin 160 and slot 152 of pivot mechanism 28B with handle 22 in the generally upright position shown in FIG. 1, As shown in FIG. 6, flanges 31A and 31B straddle tab 29 of container 20, as previously described in association with FIG. 1, with pin 160 extending between and being secured relative to the respective flanges 31A and 31B.

Automatic locking of handle 22 into the generally upright position (FIG. 1) relative to container 20 reduces customer fatigue and minimizes annoyance by preventing sideways rocking of container 20. Larger loads become easier to carry, and container 20 becomes less likely to bump a side of the customer's body while carrying handbasket 10. However, as soon as the customer sets the handbasket 10 down, gravity causes handle 22 to drop vertically relative to container 20. This maneuver enables pin 160 to slide generally downward out of slot 152 into hole portion 156 (FIG. 5A) so that as the customer releases handle 22 to terminate generally vertical upward pressure on handle 22, handle 22 automatically rotates downward to rest at upper rim 40 adjacent either side panel 74A,74B.

In one embodiment, the handle and the container are made exclusively from a plastic material. In one aspect, the plastic material is at least one of a nylon material and a high density polyethylene material.

Embodiments of the invention enable a convenient grab-and-go mechanism for picking up a handbasket via ergonomically-shaped side panels and handle. A pivot mechanism enables effortless pivoting of the handle between an unlocked, storage position in which the handle rests against an upper rim of the container and a locked, carrying position in which the handle is maintained in a generally vertically upright position. The pivot mechanism enables automatic movement of the handle to the desired position based solely on whether the customer is grasping the handle and lifting it upward, or releasing the handle and letting it drop.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A handbasket comprising:

a container having a pair of opposed side panels and a pair of opposed end panels, and defining a longitudinal axis extending between the opposed end panels; and a single handle extending between the opposed end panels of the container and being pivotally mounted at each respective opposed end panel, the handle including a longitudinal axis extending generally parallel to the longitudinal axis of the container, wherein the handle is pivotally mounted to the container by a pivot mechanism including a pin and a slot adapted to interlock with one another to limit rotation when generally vertically upward pressure is exerted on the handle;

wherein:

the handle is movable between a first position in which the handle extends generally vertically upwardly from the container and a second position in which the handle rests against an upper rim of the container, the handle remains entirely above the upper rim of the container while in the first position and the second position, and each opposed side panel of the container comprises:

an exterior surface comprising a generally concave shape defining a recess, and an interior surface defining a generally convex shape, when the handle is in the second position, the handle follows a contour of and rests upon the upper rim along a portion of each opposed end panel of the container, follows the contour of and rests upon the upper rim along one of the opposed side panels other than along the recess of the one of the opposed side panels of the container, and extends outwardly beyond the recess of the one of the opposed side panels of the container to define an opening between the handle and the recess of the one of the opposed side panels of the container, and the pivot mechanism at each opposed end panel of the container comprises:

a tab protruding generally vertically upward from the upper rim of the container, the tab defining a hole having a portion that forms the slot, and an end portion of the handle including a pair of spaced flanges and the pin, the pin extending between the spaced flanges, wherein the pin of the end portion of the handle extends through the hole of the tab of the container.

2. The handbasket of claim 1 wherein the pivot mechanism is disposed at each opposed end panel of the container for enabling the pivotal movement of the handle relative to the container, where the pivot mechanism enables automatic locking of the handle in a first generally vertical position relative to the container when generally vertically upward pressure is maintained on the handle relative to the container and enables automatic release of the handle from the first position to the second position resting against the upper rim of the container when generally vertically upward pressure on the handle is terminated.

3. The handbasket of claim 1 wherein the opening is sized and shaped to enable grasping the handle with a single hand to raise the handle from the second position to the first position.

4. The handbasket of claim 1 wherein the handle and the container are made exclusively from a plastic material.

5. The handbasket of claim 1 wherein the container comprises:

four corner portions with each one of the respective corner portions interposed between one of the respective opposed end panels and one of the respective opposed side panels;

wherein each end panel and each side panel comprises a member defining a plurality of generally round holes and each corner portion defines a generally curved member without holes.

6. The handbasket of claim 1, wherein each opposed side panel is substantially longer than each opposed end panel such that the container is elongated, and the tab is substantially centered relative to one of the opposed end panels between the pair of opposed side panels.

7. The handbasket of claim 1, wherein:

the contour of the outer rim curves radially outwardly over each of the opposed end panels and end portions of each of the opposed end panels adjacent the opposed end panels and transitions to curve radially inwardly over a midportion of each of the opposed side panels in a manner substantially following a shape of the opposed end panels and the opposed side panels, the handle is substantially U-shaped, in the second position, the handle follows the contour of the outer rim as the outer rim curves radially outwardly above the opposed end panels and the end portions of the one of the opposed side panels and only deviates from the contour of the outer rim when the outer rim transitions to curve radially inwardly over the midportion of each of the opposed side panels, and in the second position, the handle extends entirely linearly where it deviates from the contour of the outer rim.

8. The handbasket of claim 1 wherein the pin defines a generally flat member and wherein the hole of the tab of the container comprises:

the slot; and a lower portion sized and shaped to enable pivotal rotation of the pin;

wherein the slot is formed above the lower portion and is sized and shaped to enable removable, sliding insertion of the pin in the slot and to prevent rotation of the pin relative to the slot when the pin is slidably inserted within the slot.

9. The handbasket of claim 8 wherein the pin is positioned within the slot of the hole when the handle is in the first position and the pin is positioned within the lower portion of the hole of the tab when the handle is in the second position.

10. A handbasket comprising:

a container having a pair of opposed side panels and a pair of opposed end panels, and defining a longitudinal axis extending between the opposed end panels; and a single handle extending between the opposed end panels of the container and being pivotally mounted at each respective opposed end panel, the handle including a longitudinal axis extending generally parallel to the longitudinal axis of the container, wherein the handle is pivotally mounted to the container by a pivot mechanism including a pin and a slot adapted to interlock with one another to limit rotation when generally vertically upward pressure is exerted on the handle;

wherein:

the handle is movable between a first position in which the handle extends generally vertically upwardly from the container and a second position in which the handle rests against an upper rim of the container, the handle remains above the upper rim of the container while in the first position and the second position, and each opposed side panel of the container comprises:

an exterior surface comprising a generally concave shape defining recess, and an interior surface defining a generally convex shape, when the handle is in the second position, the handle follows a contour of and rests upon the upper rim along a portion of each opposed end panel of the container, follows the contour of and rests upon the upper rim along one of the opposed side panels other than along the recess of the one of the opposed side panels of the container, and extends outwardly beyond the recess of the one of the opposed side panels of the container to define an opening between the handle and the recess of the one of the opposed side panels of the container, the handle defines two end portions, a hand grip portion extending substantially perpendicular to and between the two end portions, and two corners each defined between the hand grip portion and a respective one of the two end portions, and when the handle is in the second position, each of the two corners and at least a part of the hand grip portion adjacent each of the two corners and least a part of the respective one of the two end portions adjacent each of the two corners rests on the upper rim of the container.

11. A handbasket comprising:

a container having a pair of opposed side panels and a pair of opposed end panels, and defining a longitudinal axis extending between the opposed end panels; and a single handle extending between the opposed end panels of the container and being pivotally mounted at each respective opposed end panel, the handle including a longitudinal axis extending generally parallel to the longitudinal axis of the container, wherein the handle is pivotally mounted to the container by a pivot mechanism including a pin and a slot adapted to interlock with one another to limit rotation when generally vertically upward pressure is exerted on the handle;

wherein:

the handle is movable between a first position in which the handle extends generally vertically upwardly from the container and a second position in which the handle rests against an upper rim of the container, the handle remains above the upper rim of the container while in the first position and the second position, and each opposed side panel of the container comprises:

an exterior surface comprising a generally concave shape defining a recess, and an interior surface defining a generally convex shape, when the handle is in the second position, the handle follows a contour of and rests upon the upper rim along a portion of each opposed end panel of the container, follows the contour of and rests upon the upper rim along one of the opposed side panels other than along the recess of the one of the opposed side panels of the container, and extends outwardly beyond the recess of the one of the opposed side panels of the container to define an opening between the handle and the recess of the one of the opposed side panels of the container, and the pivot mechanism at each opposed end panel of the container comprises:

a tab protruding generally vertically upward from the upper rim of the container, the tab defining a hole having a portion that forms the slot, and an end portion of the handle including a pair of spaced flanges and the pin, the pin extending between the spaced flanges, wherein the pin of the end portion of the handle extends through the hole of the tab of the container.

* * * * *